US007134566B2

(12) United States Patent
Smith et al.

(10) Patent No.: US 7,134,566 B2
(45) **Date of Patent: *Nov. 14, 2006**

(54) CONTAINER LID WITH CLOSURE MEMBER

(75) Inventors: Stephen Alan Smith, Naperville, IL (US); Dawn Ellen Huston, Lindenhurst, IL (US); Warren Giles Wiedmeyer, Trevor, WI (US); Stephen William Sullivan, Round Lake Beach, IL (US); Rich Matthiew Chin, Lincolnwood, IL (US); Mohammed Maqsood Ahmed, Niles, IL (US); John Stewart Gitschlag, Chicago, IL (US); David Raymond Langelan, Oak Park, IL (US); Rajendra Ranjitbhai Chauhan, Skokie, IL (US); William Edward Hurst, Lisle, IL (US); James Tam Joines, Jr., Gurnee, IL (US); Kevin Ray Smith, Round Lake Beach, IL (US); Mark Gerald Anhalt, Franklin, WI (US); Brian Norman Clarke, Cambridgeshire (GB)

(73) Assignee: Solo Cup Company, Highland Park, IL (US)

( * ) Notice: Subject to any disclaimer, the term of this patent is extended or adjusted under 35 U.S.C. 154(b) by 212 days.

This patent is subject to a terminal disclaimer.

(21) Appl. No.: 10/641,498

(22) Filed: Aug. 15, 2003

(65) Prior Publication Data

US 2005/0035124 A1 Feb. 17, 2005

Related U.S. Application Data

(63) Continuation of application No. 09/923,758, filed on Aug. 6, 2001, now Pat. No. 6,679,397.

(51) Int. Cl.
*B65D 51/18* (2006.01)
*B65D 55/16* (2006.01)
*A47G 19/22* (2006.01)

(52) U.S. Cl. ..... 220/254.1; 220/254.3; 220/832; 220/375; 220/713; 229/404; 229/906.1

(58) Field of Classification Search ..... 220/254.1, 220/254.3, 254.7, 375, 379, 703, 711, 713, 220/714, 716, 717; 215/306, 387; 229/404, 229/906.1; 222/543
See application file for complete search history.

(56) References Cited

U.S. PATENT DOCUMENTS

| | | | | |
|---|---|---|---|---|
| 1,237,228 | A | 8/1917 | Westover | |
| 1,725,393 | A | 8/1929 | Cone | |
| 1,752,720 | A | 4/1930 | Bergelson | |
| 1,896,976 | A | 2/1933 | Schifferdecker | |
| 2,121,554 | A | 6/1938 | Thorn | |
| 2,495,806 | A | 1/1950 | Block | |
| 2,554,710 | A | 5/1951 | Leccese | |
| 2,757,824 | A * | 8/1956 | Savary | 222/209 |
| 2,851,203 | A * | 9/1958 | Nowak | 222/543 |
| 2,886,218 | A * | 5/1959 | Marcus | 222/517 |
| 3,031,111 | A | 4/1962 | Stull | |
| 3,083,861 | A | 4/1963 | Amberg et al. | |
| 3,188,036 | A | 6/1965 | Sprung | |
| 3,193,130 | A | 7/1965 | Miller | |
| 3,262,612 | A | 7/1966 | Tabor | |
| 3,307,752 | A * | 3/1967 | Anderson | 222/465.1 |
| 3,326,401 | A | 6/1967 | De Long | |
| 3,327,905 | A | 6/1967 | Gould | |
| 3,459,324 | A | 8/1969 | Miller | |
| 3,685,517 | A * | 8/1972 | Reynolds et al. | 604/320 |
| 3,690,514 | A | 9/1972 | Wilson | |
| 3,805,991 | A | 4/1974 | Cheladze et al. | |
| 3,874,580 | A | 4/1975 | Weatherhead, III | |
| 3,994,411 | A | 11/1976 | Elfelt et al. | |
| 4,091,956 | A | 5/1978 | Vecchio | |
| 4,132,225 | A * | 1/1979 | Whattam | 600/576 |
| 4,138,033 | A | 2/1979 | Payne et al. | |
| 4,141,461 | A | 2/1979 | LaChance | |
| 4,183,443 | A | 1/1980 | DeParales et al. | |
| 4,188,457 | A | 2/1980 | Throp | |
| 4,202,459 | A * | 5/1980 | DeParales et al. | 220/712 |
| 4,203,527 | A | 5/1980 | LaChance, Sr. | |
| 4,203,528 | A * | 5/1980 | Hasegawa | 220/269 |

| | | | | |
|---|---|---|---|---|
| 4,253,582 | A | 3/1981 | Shields | |
| 4,331,255 | A | 5/1982 | Fournier | |
| 4,333,583 | A | 6/1982 | Montemarano | |
| 4,345,695 | A | 8/1982 | Galloway et al. | |
| 4,347,946 | A | 9/1982 | Nichols | |
| 4,350,260 | A | 9/1982 | Prueher | |
| 4,361,249 | A | 11/1982 | Tuneski et al. | |
| 4,420,092 | A | 12/1983 | Finkelstein | |
| 4,441,624 | A | 4/1984 | Sokolowski | |
| 4,449,640 | A | 5/1984 | Finkelstein | |
| 4,460,103 | A | 7/1984 | Rama et al. | |
| 4,478,346 | A | 10/1984 | Spong | |
| 4,503,992 | A | 3/1985 | Sitko et al. | |
| 4,557,398 | A | 12/1985 | Hambleton et al. | |
| 4,570,817 | A | 2/1986 | Hambleton et al. | |
| 4,579,245 | A | 4/1986 | Narushko | |
| 4,589,569 | A | 5/1986 | Clements | |
| 4,598,837 | A | 7/1986 | Kreiseder et al. | |
| 4,615,459 | A | 10/1986 | Clements | |
| 4,619,372 | A | 10/1986 | McFarland | |
| 4,629,088 | A | 12/1986 | Durgin | |
| 4,643,326 | A * | 2/1987 | Klingler | 220/710.5 |
| 4,657,139 | A | 4/1987 | Hanifl | |
| 4,703,873 | A | 11/1987 | Geren | |
| 4,705,197 | A | 11/1987 | Gordon et al. | |
| 4,718,570 | A | 1/1988 | Diener | |
| 4,738,373 | A | 4/1988 | DeParales | |
| 4,741,450 | A | 5/1988 | Braude | |
| 4,747,511 | A | 5/1988 | Dutt et al. | |
| 4,753,365 | A | 6/1988 | Seppala | |
| 4,754,895 | A * | 7/1988 | Lardner et al. | 220/288 |
| 4,770,325 | A | 9/1988 | Gordon et al. | |
| 4,782,975 | A | 11/1988 | Coy | |
| 4,790,444 | A | 12/1988 | Terzi | |
| 4,792,054 | A | 12/1988 | Weidman | |
| 4,796,774 | A | 1/1989 | Nabinger | |
| 4,856,622 | A * | 8/1989 | Sartain et al. | 188/170 |
| 4,863,051 | A | 9/1989 | Eibner et al. | |
| 4,869,389 | A | 9/1989 | Cerrone, Jr. | |
| 4,874,103 | A | 10/1989 | Quisenberry et al. | |
| 4,898,295 | A | 2/1990 | Kim | |
| 4,899,902 | A | 2/1990 | DeMars | |
| 4,915,250 | A | 4/1990 | Hayes, Jr. | |
| 4,930,654 | A | 6/1990 | Thibeault et al. | |
| 4,932,555 | A | 6/1990 | La Barge | |
| 4,938,379 | A | 7/1990 | Kellner | |
| 4,949,865 | A | 8/1990 | Turner | |
| 4,953,743 | A | 9/1990 | Dart et al. | |
| 4,966,300 | A | 10/1990 | Coonradt | |
| 5,012,061 | A | 4/1991 | Lesser | |
| 5,088,614 | A * | 2/1992 | Dumestre | 220/713 |
| 5,090,584 | A | 2/1992 | Roberts et al. | |
| 5,111,961 | A | 5/1992 | Van Melle | |
| 5,148,936 | A | 9/1992 | DeGrow | |
| 5,154,327 | A * | 10/1992 | Long | 222/326 |
| 5,167,338 | A | 12/1992 | Kick | |
| 5,180,073 | A | 1/1993 | Fay et al. | |
| 5,183,172 | A | 2/1993 | Boller | |
| 5,193,704 | A | 3/1993 | Kick | |
| 5,197,624 | A | 3/1993 | Doddaro | |
| 5,205,430 | A | 4/1993 | Valyi | |
| 5,294,014 | A | 3/1994 | Wyatt et al. | |
| D346,718 | S | 5/1994 | Timmermans | |
| 5,392,949 | A * | 2/1995 | McKenna | 220/712 |
| 5,395,006 | A | 3/1995 | Verma | |
| 5,398,843 | A | 3/1995 | Warden et al. | |
| 5,415,312 | A | 5/1995 | Mueller | |
| 5,421,472 | A | 6/1995 | Beckertgis | |
| 5,449,085 | A | 9/1995 | Brun, Jr. | |
| 5,485,938 | A | 1/1996 | Boersma | |
| 5,490,609 | A | 2/1996 | Lane et al. | |
| 5,495,941 | A | 3/1996 | Leonard | |
| 5,497,920 | A | 3/1996 | Moeller et al. | |
| D368,624 | S | 4/1996 | Forrer | |
| 5,503,289 | A | 4/1996 | Fox | |
| 5,503,662 | A | 4/1996 | Berger | |
| 5,588,561 | A | 12/1996 | Ness | |
| 5,613,619 | A | 3/1997 | Van Melle | |
| 5,699,927 | A | 12/1997 | Lane et al. | |
| 5,706,972 | A | 1/1998 | Sousa | |
| 5,718,353 | A | 2/1998 | Kanfer et al. | |
| 5,727,707 | A | 3/1998 | Wickland et al. | |
| 5,753,289 | A * | 5/1998 | Ness | 426/394 |
| 5,766,660 | A | 6/1998 | Lee et al. | |
| 5,775,205 | A | 7/1998 | Melton | |
| 5,839,601 | A | 11/1998 | Van Melle | |
| D402,556 | S | 12/1998 | Frye | |
| 5,866,184 | A | 2/1999 | Gorlich et al. | |
| 5,873,298 | A | 2/1999 | Chang | |
| 5,911,331 | A | 6/1999 | Boller | |
| 5,913,964 | A | 6/1999 | Melton | |
| 5,947,319 | A | 9/1999 | Sinski | |
| 5,947,323 | A | 9/1999 | Freek et al. | |
| 5,954,241 | A | 9/1999 | Huang | |
| 5,979,689 | A | 11/1999 | Lansky | |
| 5,984,127 | A | 11/1999 | Fenton | |
| 5,996,837 | A | 12/1999 | Freek et al. | |
| 6,003,711 | A | 12/1999 | Bilewitz | |
| 6,010,029 | A | 1/2000 | Wang | |
| 6,089,397 | A | 7/2000 | Van Melle | |
| 6,095,033 | A | 8/2000 | Melton | |
| 6,176,384 | B1 | 1/2001 | Voloshin | |
| D437,223 | S | 2/2001 | Coy et al. | |
| 6,199,711 | B1 | 3/2001 | Lansky | |
| 6,216,904 | B1 | 4/2001 | Cagan | |
| 6,220,470 | B1 | 4/2001 | McHenry et al. | |
| 6,305,571 | B1 | 10/2001 | Chu | |
| 6,364,101 | B1 * | 4/2002 | Schultz | 206/210 |
| 6,374,726 | B1 | 4/2002 | Melton | |
| 6,419,105 | B1 | 7/2002 | Bruce et al. | |
| 6,578,726 | B1 | 6/2003 | Schaefer | |
| 6,612,456 | B1 | 9/2003 | Hundley et al. | |
| D480,968 | S | 10/2003 | Atkins et al. | |
| 6,644,490 | B1 | 11/2003 | Clarke | |
| 6,679,397 | B1 * | 1/2004 | Smith et al. | 220/254.1 |
| 6,886,707 | B1 * | 5/2005 | Giraud | 220/254.4 |
| 2002/0027139 | A1 | 3/2002 | O'Neill | |
| 2003/0089713 | A1 | 5/2003 | Belt et al. | |
| 2003/0089714 | A1 | 5/2003 | Dart et al. | |
| 2003/0141302 | A1 | 7/2003 | Ryan et al. | |
| 2004/0118847 | A1 * | 6/2004 | Giraud | 220/254.3 |
| 2004/0256386 | A1 * | 12/2004 | LaFortune | 220/254.1 |
| 2005/0092748 | A1 * | 5/2005 | Durdon | 220/254.3 |

FOREIGN PATENT DOCUMENTS

| | | | |
|---|---|---|---|
| CH | 393 955 | | 11/1965 |
| DE | 18 16 709 | A | 2/1970 |
| DE | 295 02 654 | U1 | 8/1995 |
| EP | 0 160 372 | A | 11/1985 |
| EP | 0 383 442 | A1 | 8/1990 |
| GB | 1 576 126 | A | 10/1980 |
| GB | 1 600 917 | | 10/1981 |
| GB | 2 091 232 | A | 7/1982 |
| GB | 2 182 027 | A | 5/1987 |
| GB | 2264858 | A * | 9/1993 |
| JP | 07-309379 | | 11/1995 |
| JP | 10-129706 | A | 5/1998 |
| JP | 2000-159254 | | 6/2000 |
| WO | WO 9303973 | A1 * | 3/1993 |
| WO | WO 99 47429 | | 9/1999 |
| WO | WO 00 51908 | | 9/2000 |

OTHER PUBLICATIONS

Copy of photograph of HotJo Ceramic Mug/Lid obtained through market research, Apr. 2000.

Copy of photograph of Starbucks Cup/Lid obtained through market research, Apr. 2000.
Copy of photograph of Super America Cup/Lid obtained through market research, Apr. 2000.
Copy of photograph of Dunkin Donuts Cup/Lid obtained through market research, Apr. 2000.
Berrington, N., *International Search Report,* Sep. 4, 2002, 6 pp., Patent Cooperation Treaty, Rijswijk, Netherlands.
Seven (7) color photographs showing different views of Whirley Thermo Mug/Lid obtained in Feb. 2003.
US 6,003,721, 12/1999, Fleming (withdrawn)

* cited by examiner

*Primary Examiner*—Nathan J. Newhouse
*Assistant Examiner*—James Smalley
(74) *Attorney, Agent, or Firm*—Wallenstein & Wagner, Ltd.

(57) ABSTRACT

A lid for a container holding a flowable substance has an annular top wall. A side wall depends from the top wall, and has a mounting portion for connecting the lid on the container. The top wall has an opening that is adapted to permit the flow of the substance through the lid. The top wall also has a retaining member. The lid further has a closure member positioned on the mounting portion. The closure member is movable between a first position and a second position, wherein at least a portion of the closure member is received in the opening in the first position and at least a portion of the closure member is received in the retaining member in the second position. The opening and the closure member are cooperatively dimensioned such that the closure member is removably inserted in the opening. The retaining member and the closure member are cooperatively dimensioned such that the closure member is removably inserted in the retaining member. The closure member has a flexible connector arm which facilitates movement of the closure member between the first and second positions.

15 Claims, 4 Drawing Sheets

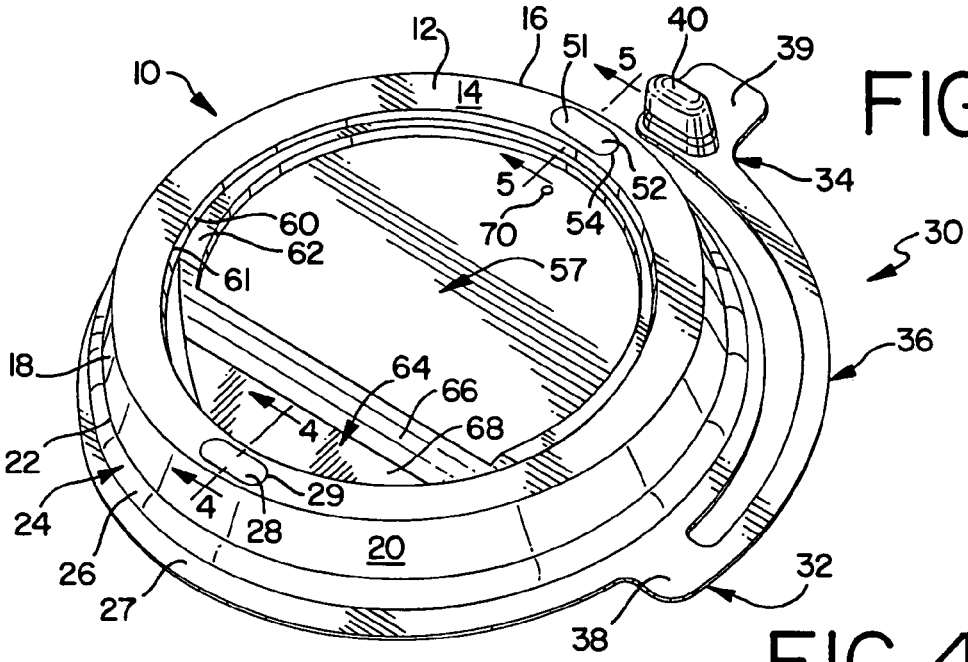
FIG. 1
FIG. 2
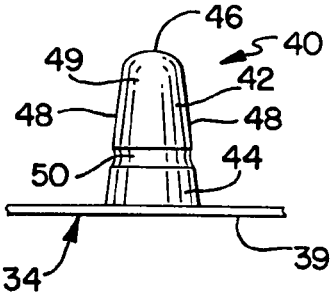
FIG. 4
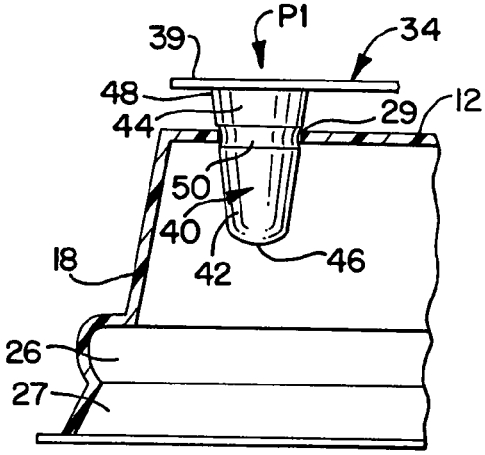
FIG. 3
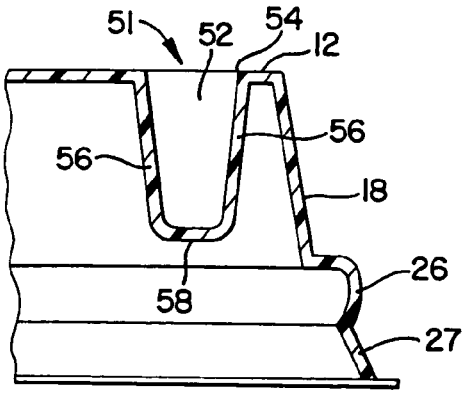
FIG. 5
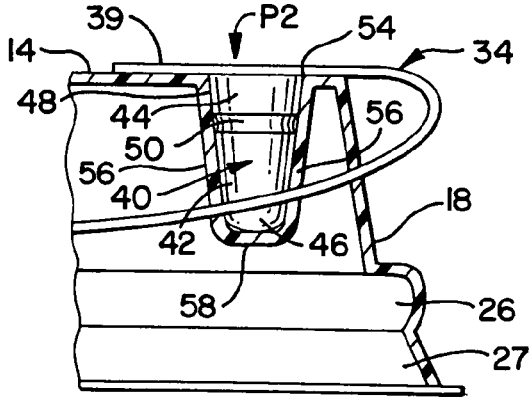

CONTAINER LID WITH CLOSURE MEMBER

CROSS-REFERENCE TO RELATED APPLICATIONS

This application is a continuation of prior U.S. application Ser. No. 09/923,758 filed Aug. 6, 2001, now U.S. Pat. No. 6,679,397.

FEDERALLY SPONSORED RESEARCH OR DEVELOPMENT

Not Applicable.

TECHNICAL FIELD

The present invention relates to a lid for a container. More specifically, the present invention relates to a lid for a flowable substance container wherein the lid includes a closure member.

BACKGROUND OF THE INVENTION

Lids for containers are well-known in the beverage container industry. In general terms, lids for single-use or disposable containers have three main components: a top wall or surface, a mounting portion, and an opening. Typically, the mounting portion is adapted to engage an upper rim of the container to seal the lid on the container. The opening is adapted to permit the flow of the container contents through the lid.

Existing lid designs suffer from a number of problems including untimely spillage through the opening due to the lack of a reliable means for sealing the opening. The inability to effectively seal the opening can also result in a significant loss of heat from the container contents through the opening. To address these and other problems, a number of lid designs include a cover portion for the opening. However, most cover portions lack structural integrity and can interfere with a user consuming the container contents through the opening.

U.S. Pat. No. 4,738,373 to DeParales discloses a container lid where the opening is formed after a hinged tear panel is removed from an outer edge of the lid. Due to its hinged construction, the tear panel can unexpectedly rotate back towards the edge while a user is drinking from the container, thereby interfering with the discharge of the container contents. In addition, it is quite difficult to completely re-seal the opening with the tear panel once it is initially removed from the edge of the container.

Another example of a lid having an attached cover for the opening is disclosed in U.S. Pat. No. 4,899,902 to DeMars. There, a cover is placed over a spout extending upward from the lid. The lid contains no structure to retain and/or secure the cover once it is removed from the spout. Because the cover remains unsecured while the user is drinking from the container, the cover can obstruct the use of the lid. Accordingly, the effectiveness of the lid is compromised.

Therefore, there is a definite need for a container lid with a cover portion that effectively re-seals the opening therein. In addition, there is a need for lid with a cover portion that can be reliably secured such that the cover portion does not interfere with the discharge of the container contents.

The present invention is provided to solve these and other problems.

SUMMARY OF THE INVENTION

The present invention relates to a lid for a container holding a flowable substance. The lid has an annular top wall and a side wall depending from the top wall. The side wall has a mounting portion for connecting the lid on the container. The lid includes an opening in the top wall, the opening adapted to permit the flow of the substance through the lid. A retaining member is positioned in the top wall.

In accord with the invention, the lid includes a closure member positioned on the mounting portion, the closure member having a plug. In further accord with the invention, the closure member is movable between a first position and a second position, wherein at least a portion of the plug is received in the opening in the first position and wherein at least a portion of the plug is received in the retaining member in the second position.

In still further accord with the invention, the opening and the plug are cooperatively dimensioned such that at least a portion of the plug is removably inserted in the opening. Similarly, the retaining member and the plug are cooperatively dimensioned such that at least a portion of the plug is removably inserted in the retaining member. The closure member is flexible thereby facilitating movement of the closure member between the first and second positions.

Other features and advantages of the invention will be apparent from the following specification taken in conjunction with the following drawings.

BRIEF DESCRIPTION OF THE DRAWINGS

FIG. 1 is a perspective view of the lid of the present invention, showing a closure member extending from the lid;

FIG. 2 is a partial end view of the closure member of the lid of FIG. 1;

FIG. 3 is a partial cross-sectional view of a retaining member of the lid of FIG. 1;

FIG. 4 is a partial cross-sectional view of the closure member received by an opening of the lid of FIG. 1;

FIG. 5 is a partial cross-sectional view of the closure member received by a retaining member of the lid of FIG. 1;

DETAILED DESCRIPTION OF THE INVENTION

Figure 6:
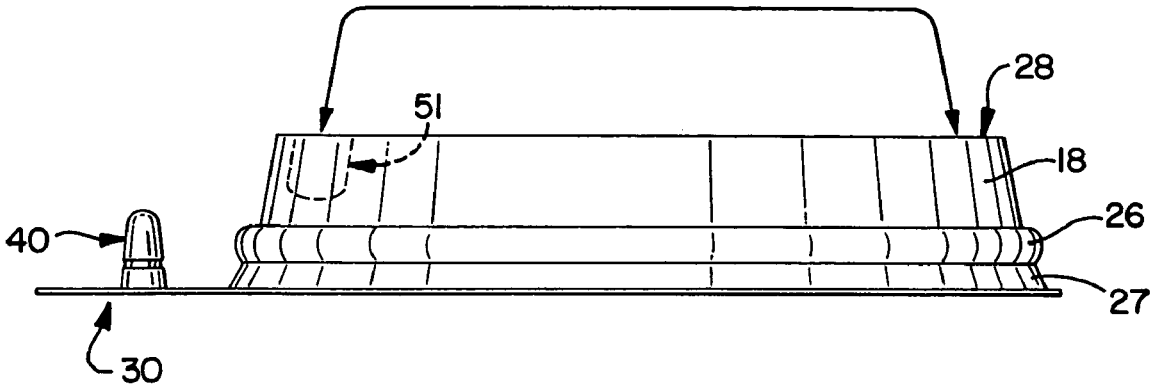
FIG. 6 is end view of the lid of FIG. 1, showing the path of movement of the closure member between a first position and a second position.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A lid 10 for a container (not shown) of the present invention is illustrated in FIG. 1. The container has a central opening defining a volume that can be used to contain or hold a flowable substance, for example a liquid or a powder. It is understood that the container can assume a variety of different forms and shapes.

The lid 10 includes a generally annular top wall 12 with a top wall surface 14 and an outer peripheral edge 16. A generally annular outer side wall 18 depends from top wall 12 at the peripheral edge 16. The side wall 18 has a side wall surface 20 and a lower edge 22. A mounting portion 24 depends from the side wall 18 at the lower edge 22. The mounting portion 24 includes a generally annular flange 26 and a generally annular skirt 27. The mounting portion 24 is adapted for connecting the lid 10 to the container in a manner that seals the lid 10 on the container. Thus, the mounting portion 24 prevents leakage of the container contents between the lid 10 and the container when the lid 10 is positioned on the container. In a preferred embodiment, the container contents are a liquid and the mounting portion 24 is integral with the side wall 18.

An aperture or drink opening 28 is preferably located in the top wall surface 14. Alternatively, the opening 28 can be located in a portion of the side wall 18. The opening 28 is adapted to permit the passage or flow of the flowable substance held by the container through the lid 10. The opening 28 has an edge 29 that defines the shape of the opening 28. Although shown in FIG. 1 as having an oval or obround shape, the opening 28 can have a variety of shapes, including but not limited to circular, square, or rectangular.

As further shown in FIG. 1, the lid 10 also has a closure member 30. In a preferred embodiment, closure member 30 is positioned on a portion of the annular skirt 27. The closure member 30 includes a first end 32, a second end 34, and an intermediate portion 36. The first end 32 includes a base portion 38, which can have various configurations, including the rounded edge shown in FIG. 1. Preferably, the first end 32 extends from the skirt 27, however, the first end 32 could depend from a portion of the top wall 12, the side wall 18, or the mounting portion 24. The closure member 30 is preferably formed from the same material of the lid 10.

The intermediate portion or arm 36 connects the first end 32 and second end 34. Preferably, the arm 36 is flexible and has a curvilinear, arc shape that is similar to the curvilinear shape of the mounting portion 24 and/or the top wall 12. The arc length of the closure member 30, as measured from the first end 32 to the second end 34, can vary according to numerous design parameters. Preferably, the arc length ranges from one-fifth to one-half the circumference of the top wall 12. In a most preferred embodiment, the arc length is approximately 90 degrees. Described in another manner, a vector drawn radially inward from each of ends 32, 34 would intersect to form an approximately 90 degree angle.

The second end 34 has a tab 39 and a plug 40. As shown in FIG. 2, the plug 40 has a generally catenoid shape. The plug 40 has an upper portion 42 and a lower portion 44, where the upper portion 42 has a nose 46. The plug 40 has opposed side walls 48 and opposed end walls 49. Preferably, the walls 48, 49 are sloped. A notch 50 can be located between the upper portion 42 and the lower portion 44. The tab 39 is adapted to permit the movement of the closure member 30 by a user grasping the tab 39.

As shown in FIG. 1, a retaining member 51 is preferably located in the top wall 12. Alternatively, the retaining member 51 is located in a portion of the side wall 18 or a portion of the mounting portion 24. The retaining member 51 includes a cavity 52 adapted to receive and/or secure the plug 40 of the closure member 30. The cavity 52 has an upper edge 54 defining the shape of the cavity 52. Although shown in FIG. 1 as having an obround shape, the cavity 28 can have a variety of shapes, including but not limited to circular, square, or rectangular. Referring to FIG. 3, an inner wall 56 depends from the upper edge 54 and terminates at a generally planar bottom wall 58. Preferably the inner wall 56 is sloped to facilitate engagement with the notch 50 and/or a portion of the side and end walls 48, 49 during the insertion and/or the removal of the plug 40. Because the retaining member 51 has a bottom wall 58, the flowable substance in the container cannot flow through the member 51. Furthermore, the retaining member 51 is generally configured to receive at least a portion of the plug 40 in an interference fit as described in greater detail below.

Figure 8:
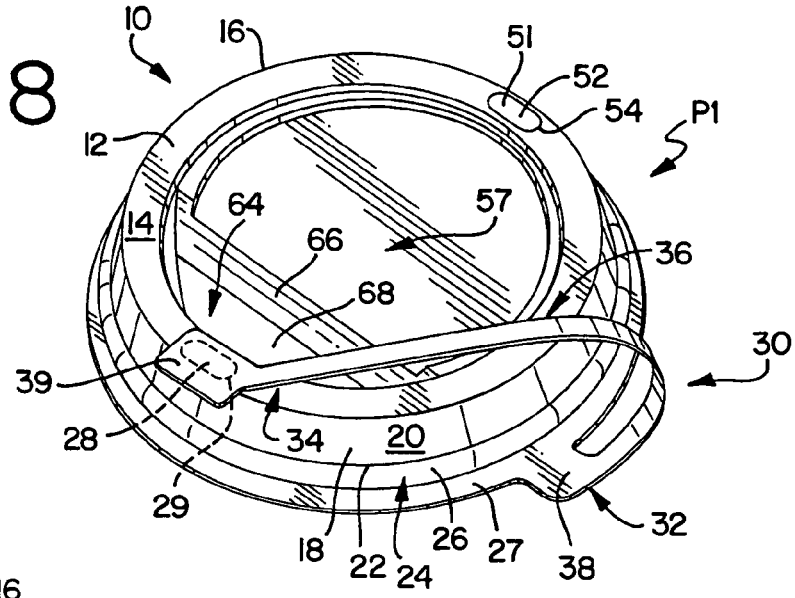
FIG. 8 is a perspective view of the lid of FIG. 1, showing the closure member in the first position.

At a first position P1, the opening 28 receives at least a portion of the plug 40. As shown in FIGS. 4 and 8, when the plug 40 is located in the first position, the edge 29 of the opening 28 is in frictional engagement with a portion of the walls 48, 49 of the plug 40. In a preferred embodiment, at first position P1, the notch 50 is proximate the edge 29. Described in a different manner, the plug 40 and the opening 28 are in an interference fit wherein at least a portion of the upper portion 42 and the nose 46 are positioned below the top wall 12. Alternatively, the plug 40 can be further inserted into the opening 28 such that at least a portion of the lower portion 44 is positioned below the top wall 12. When the closure member 30 is in the first position P1, the plug 40 forms a seal with the opening 28. This seal prevents the flow of the flowable substance in the container through the opening 28, enabling the container and lid 10 to be moved without risking spillage. Alternatively, the plug 40 and the opening 28 are in a snap fit engagement, or interference engagement wherein each have sufficient structure to enable such engagement. Other cooperating structures can also be utilized.

Figure 9:
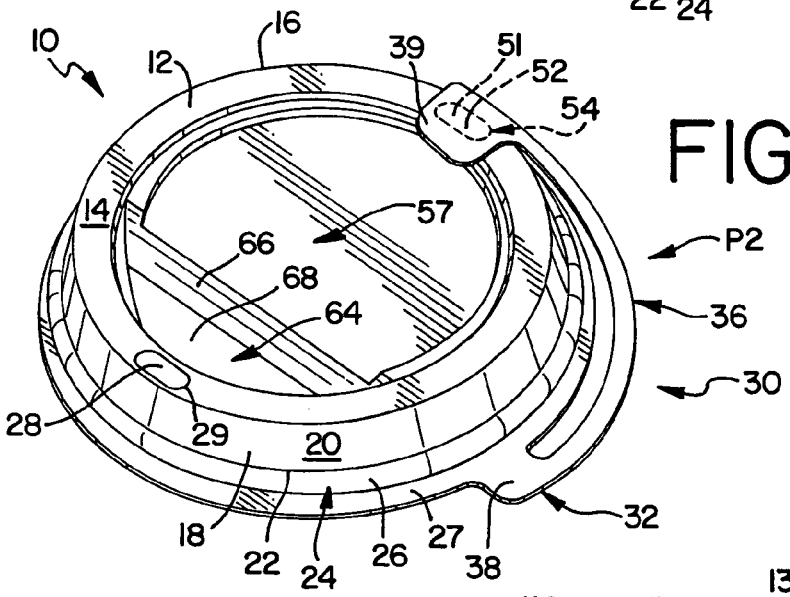
FIG. 9 is a perspective view of the lid of FIG. 1, showing the closure member in the second position.

At a second position, P2, the retaining member 51 receives at least a portion of the plug 40. As shown in FIGS. 5 and 9, when the plug 40 is located in the second position P2, the upper edge 54 of the cavity 52 and/or a portion of the side wall 56 is in frictional engagement with the side walls 48 of the plug 40 and a portion of the lower portion 44 is proximate the top wall surface 14. Described in a different manner, the plug 40 and the cavity 52 are in an interference fit wherein at least a portion of the upper portion 42 and the nose 46 are positioned below the top wall 12. Alternatively, the degree of insertion of the plug 40 is reduced such that the notch 50 is proximate the edge 54. When the closure member 30 is in the second position P2, the plug 40 is secured in place thereby preventing unwanted movement of the closure member 30. This securement prevents the plug 40 and the closure member 30 from becoming dislodged while a user discharges the contents of the container through the opening 28. Alternatively, the plug 40 and the cavity 52 are in a snap fit engagement, or interference engagement wherein each have sufficient structure to enable such engagement. By retaining the plug 40 in the second position P2, the closure member 30 does not interfere with a user discharging the flowable contents through the opening 28.

Once the plug 40 is dislodged from the opening 28, the closure member 30 is movable from the first position P1 to the second position P2. Similarly, once the once the plug 40 is dislodged from the retaining member 51, the closure member 30 is movable from the second position P2 to the first position P1. Referring to FIG. 6, when the closure member 30 moves between the first position P1 and the second position P2, the plug 40 can rotate along a curvilinear path, CP, above the top wall 12. Since the closure member 30 rotates about the fixed base portion 38, the rotation of the second end 34 and the plug 40 can be characterized as planar, where the second end 34 and the plug 40 rotate in a generally vertical plane. Described in a different manner, the second end 34 and the plug 40 rotate in a plane that is generally perpendicular to a horizontal plane defined by the top wall 12. A living hinge is embodied within the closure member 30 which facilitates the movement of the closure member 30 between the first position P1 and second position P2. Preferably, the living hinge is positioned proximal the first end 32.

At an alternate second position P2, the plug 40 is neither received by the opening 28 nor the retaining member 51. Instead, the plug 40 is positioned a distance from the mounting portion 24 as shown in FIG. 1. In the alternate second position P2, the movement of the plug 40 is restricted only by the configuration and structure of the closure member 30. However, a user can move the plug 40 from the alternate second position P2 into engagement with the opening 28. In the alternate second position P2, the closure member 30 generally does not interfere with a user discharging the flowable contents through the opening 28.

Alternatively, the retaining member 51 can include other means to retain the closure member 30. For example, a pin can be positioned on one of either the retaining member 51 or the closure member 30. A socket adapted to receive the pin can be positioned on the other of the retaining member 51 or the closure member 30. The pin and socket are cooperatively dimensioned such that the pin is received by the socket and as a result, the plug 40 is retained in the retaining member 51. As another example, a portion of the retaining member 51 has a plurality of teeth configured to cooperatively engage a plurality of teeth located on a portion of the closure member 30. The retaining member 51 and the closure member 30 can be proximately positioned such that the teeth intermesh or engage. In this manner, the plug 40 is retained by the retaining member 51.

Unlike prior art designs, the dimensions and the configuration of the opening 28 are not affected by either the insertion of the plug 40 into the opening 28 or the removal of the plug 40 from the opening 28. Similarly, the dimensions and the configuration of the retaining member 51 are not affected by either the insertion of the plug 40 into the opening 28 or the removal of the plug 40 from the retaining member 51. As a result, the dimensions and the configuration of both the opening 28 and the retaining member 51 remain constant when the closure member 30 moves between the first position and the second position. This attribute allows a user to repeatedly move the closure member 30 between the first position and second position. Accordingly, the structural integrity and the durability of the lid 10 are increased.

Referring to FIG. 1, the lid 10 includes a center portion 57 positioned radially inward of the top wall 12. An inner side wall 60 depends from an inner edge 61 of the top wall 12. A ridge 62 is located at the base of the side wall 60 proximate the center portion 57. The ridge 62 increases the structural rigidity of the lid 10. Furthermore, the ridge 62 and the center portion 57 facilitate the stacking of multiple combinations of a lid 10 and a container, meaning a first lid 10 connected to a first container stacked on a second lid 10 connected to a second container. In this configuration, the ridge 62 and the center portion 57 of the second lid 10 act as a receiver and a locating feature to engage a lower portion of the first container. Consequently, the first lid 10 and the first container are stacked on the second lid 10 and the second container in a stable and secure manner, which increases the flexibility and marketability of the lid 10.

The center portion 57 includes a recessed portion 64 that is adapted to receive a lip of a person drinking from the container. The shape and configuration of the recessed portion 64 can be varied to conform to numerous design parameters. The recessed portion 64 can include a first wall 66 and a second wall 68 where both walls are sloped causing the recessed portion 64 to have a generally inclined surface. Due to the sloped walls 66, 68, the height of the inner side wall 60 at the recessed portion 64 is greater than the height of the inner side wall 60 at the center portion 57.

As shown in FIG. 1, a vent hole 70 can be located in the center portion 57 of the lid 10. Preferably, the vent hole 70 is located in the center portion 57 proximate the ridge 62; however, the vent hole 70 can be located in the top wall 12. The vent hole 70 is adapted to ensure the continuous flow of the container contents through the opening 28 while venting the container.

A drain hole (not shown) can be located in the recessed portion 64, preferably in the second wall 68 near the side wall 60 and in alignment with the drink opening 28. When the flowable contents, i.e. liquid, accumulate in the recessed portion 64, the drain hole 72 ensures the drainage of such contents into the container.

The opening 28 can be formed with a range of dimensions. At a minimum, the opening 28 should have dimensions sufficient to permit the passage of the flowable substance held by the container and receive the plug 40. The retaining member 51 can be formed with a range of dimensions. At a minimum, the retaining member 51 should have dimensions sufficient to receive and secure the plug 40.

The opening 28 can be located at various positions along the top wall 12 depending upon design parameters. Similarly, the retaining member 51 can be located at various positions along the top wall 12. The opening 28 and the retaining member 51 can be proximate each other, or spaced a distance apart. Preferably, the opening 28 and the retaining member 51 are opposed on the top wall 12, meaning that they are positioned approximately 180 degrees apart.

The closure member 30 can be positioned in a number of locations between the opening 28 and the retaining member 51. However, the first end 32 of the closure member 30 is preferably positioned approximately 90 degrees from the opening 28. Described in another manner, the first end 32 is positioned approximately 90 degrees from retaining member 51. Described in yet another manner, the second end 34 is positioned approximately 180 degrees from the opening 28.

Although shown as having a generally circular shape, the lid 10, including the mounting portion 24, the flange 26 and the skirt 28, can have numerous configurations. For example, the lid 10 could have a rectangular, square, or oval shape. To ensure a leak-proof seal with the container, the shape of the mounting portion 24 should match the shape of the upper edge of the container so a cooperative sealing engagement can be achieved.

Alternatively, the mounting portion 24 could have a shape similar to the upper edge of the container, yet dissimilar from the shape of the side wall 18 and the top wall 12. For example, the mounting portion 24 could have an annular shape consistent with the container shape and the walls 12, 18 could have a non-annular shape.

The lid 10 can be manufactured by a variety of manufacturing processes, such as injection molding or a thermoforming operation, preferably vacuum forming and/or pressure forming. The lid 10 is preferably formed from plastic, however, other lightweight materials can be used to form the lid 10. Preferably, the lid 10 is formed from a one piece construction, meaning that the closure member 30 is integrally formed with the lid 10. Alternatively, the closure member 30 can be connected to the lid in a separate step of the formation process.

After the thermoforming operation has been completed, the drink opening 28, the vent hole 70 and the drain hole may be formed in the lid 10. The drink opening 28, the vent hole 70 and the drain hole can be formed with a punch and die. The vent hole 70 and drain hole, which are generally smaller than the drink opening 28, may each be formed by puncturing the lid 10 with a pointed tool.

Figure 7:
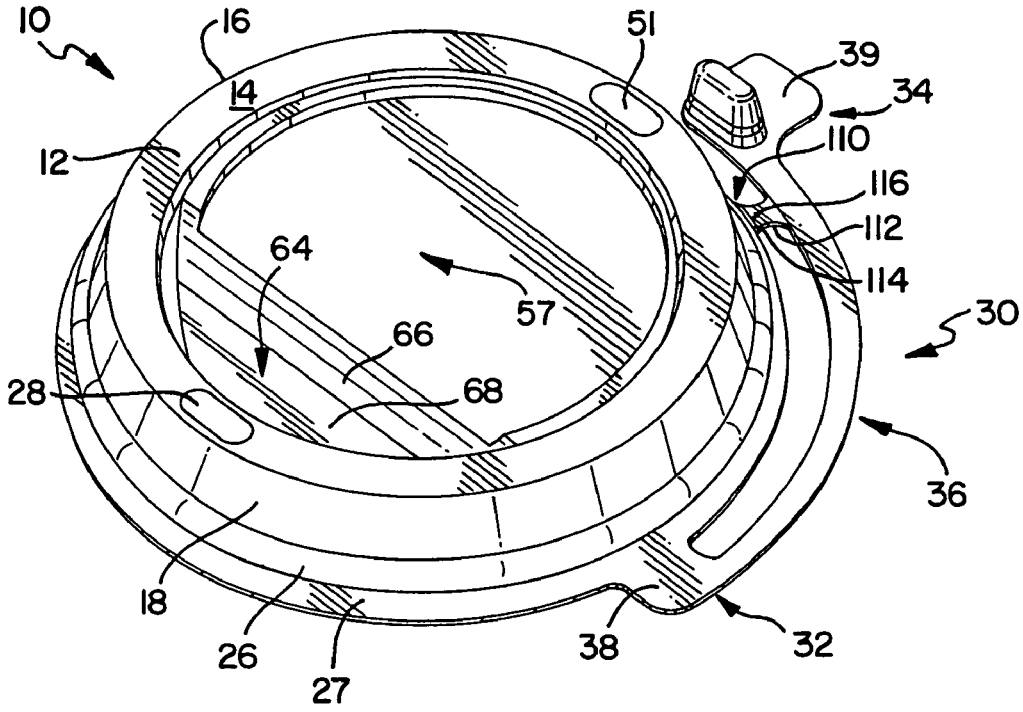
FIG. 7 is a perspective view of an alternate embodiment of the lid of the present invention, showing a securing member positioned between the lid and the closure member.

In another preferred embodiment shown in FIG. 7, the lid 10 includes a securing tab 110 adapted to secure the closure member 30 to the lid 10. The securing tab 110 includes a first portion 112 attached proximate the second end 34 of the closure member 30, and a second portion 114 attached to the skirt 27. A seam 116 can be located between the first and second portions 112, 114. The position, configuration and length of the securing tab 110 can vary with the design parameters, including the configuration of the closure member 30 and the mounting portion 24. The securing tab 110 can be positioned in various locations along the skirt 27. This means that the securing tab 110 can be positioned proximate the first end 32, proximate the second end 34, or at a location between the first and second ends 32, 34. In addition, the securing tab 110 can be connected to a portion of the top wall 14, the side wall 18, or the mounting portion 24.

The securing tab 110 is adapted to rupture along the seam 116 when a sufficient amount of force is applied to the tab 110. Prior to being ruptured, the securing tab 110 fixes the closure member 30 in a generally stable position such that a plurality of lids 10 can be stacked in a vertical configuration. The ability to vertically stack a plurality of lids 10 increases the marketability and versatility of the lid 10 because less storage space is required. After the securing tab 110 is ruptured, the closure member 30 is adapted for movement between the first and second positions P1, P2 about the fixed base portion 38.

Alternatively, the securing tab 110 can be adapted for reattachment after rupture of the tab 110. For example, the first portion 112 can have a plurality of teeth configured to cooperatively engage a plurality of teeth on the second portion 114. After the securing tab 110 is ruptured, the first and second portions 112, 114 can be proximately positioned such that the teeth intermesh or engage. In this manner, the securing tab 110 is reattached and the closure member 30 is fixed in a generally stable position such that the closure member 30 does not interfere with a user discharging the flowable contents through the lid 10.

In another preferred embodiment (not shown), the closure member is formed without a base portion extending from the skirt. In this configuration, there is no space between the skirt and the closure member such that the closure member is proximate the skirt. As a result, the closure member is directly connected to the skirt along the entire length of the closure member. In this configuration, the closure member cannot be moved between the first and second positions P1, P2. Alternatively, the closure member is connected to a portion of the top wall, the side wall, or the mounting portion.

To detach the closure member, a seam is positioned between the closure member and the skirt. The seam is frangible, meaning that it is adapted to be torn or ruptured when a sufficient amount of force is applied in the proper direction. A tear stop is located along the seam and is adapted to halt the tearing or rupturing of the seam. Preferably, the tear stop is located in a portion of the first end of the closure member. Once an appropriate amount of force is applied in the proper direction, the seam begins to rupture and continues to rupture until the tear stop halts the rupturing process. As a result, the closure member is detached from the skirt and is no longer connected to the lid. Consequently, the closure member can be moved between the first and second positions P1, P2.

Figure 10:
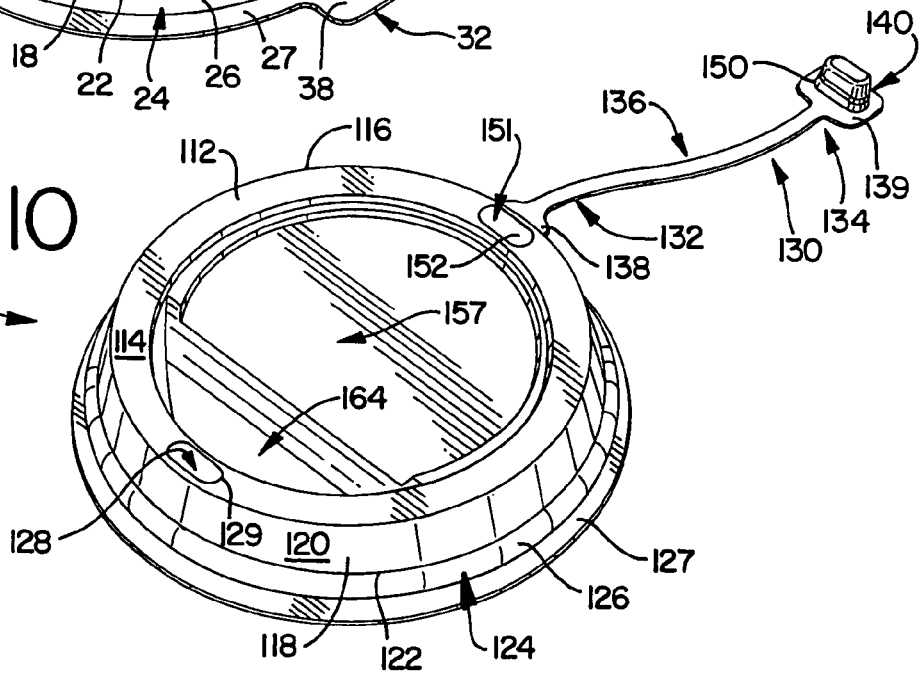
FIG. 10 is a perspective view of an alternate embodiment of the lid of the present invention, showing a closure member extending transversely from the lid.

Another preferred embodiment is shown in FIG. 10. The lid 110 includes a generally annular top wall 112 with a top wall surface 114 and an outer peripheral edge 116. A generally annular outer side wall 118 depends from top wall 112 at the peripheral edge 116. The side wall 118 has a side wall surface 120 and a lower edge 122. A mounting portion 124 depends from the side wall 118 at the lower edge 122. The mounting portion 124 includes a generally annular flange 126 and a generally annular skirt 127.

A drink opening 128 is preferably located in the top wall surface 114. The opening 128 has an edge 129 that defines the shape of the opening 128. The opening 128 is adapted to permit the passage or flow of the flowable substance held by the container through the lid 110.

The lid 110 also has a closure member 130. Preferably, the closure member 130 is positioned on a portion of the annular skirt 127. The closure member 130 includes a first end 132, a second end 134, and an intermediate portion 136. The first end 132 includes a base portion 138. Preferably, the first end 132 extends from the skirt 127, however, the first end 132 could depend from a portion of the top wall 112, the side wall 118, or the mounting portion 124. The closure member 130 is preferably formed from the same material of the lid 110. The closure member 130 is adapted to be flexible. The second end 134 has a tab 139 and a plug 140. A notch 150 can be located between an upper portion and a lower portion of the plug 140.

As shown in FIG. 10, a retaining member 151 is preferably located in the top wall 112. Alternatively, the retaining member 151 is located in a portion of the side wall 118 or a portion of the mounting portion 124. The retaining member 151 includes a cavity 152 adapted to receive and/or secure the plug 140 of the closure member 130. An inner wall depends from an upper edge (not shown) of the member 151 and terminates at a generally planar bottom wall. The retaining member 151 is generally configured to receive at least a portion of the plug 140 in an interference fit as described in greater detail below.

At a first position P1, the opening 128 receives at least a portion of the plug 140. When the plug 140 is located in the first position, the edge 129 of the opening 128 is in frictional engagement with a portion of the plug 140. Described in a different manner, the plug 140 and the opening 128 are in an interference fit wherein at least a portion of the plug 140 is positioned below the top wall 112. When the closure member 130 is in the first position P1, the plug 140 forms a seal with the opening 128. This seal prevents the flow of the flowable substance in the container through the opening 128, enabling the container and lid 110 to be moved without risking spillage.

At a second position, P2, the retaining member 151 receives at least a portion of the plug 140. When the plug 140 is located in the second position P2, a portion of the retaining member 151 is in frictional engagement with a portion of the plug 140. Described in a different manner, the plug 140 and the cavity 152 are in an interference fit wherein at least a portion of the plug 140 are positioned below the top wall 112. When the closure member 130 is in the second position P2, the plug 140 is secured in place thereby preventing unwanted movement of the closure member 130. This securement prevents the plug 140 and the closure member 130 from becoming dislodged while a user discharges the contents of the container through the opening 128. By retaining the plug 140 in the second position P2, the closure member 130 does not interfere with a user discharging the flowable contents through the opening 128.

Once the plug 140 is dislodged from the opening 128, the closure member 130 is movable from the first position P1 to the second position P2. Similarly, once the once the plug 140 is dislodged from the retaining member 151, the closure member 130 is movable from the second position P2 to the first position P1.

The lid 110 includes a center portion 157 positioned radially inward of the top wall 112. The center portion 157 includes a recessed portion 164 that is adapted to receive a lip of a person drinking from the container. The shape and configuration of the recessed portion 164 can be varied to conform to numerous design parameters.

Referring to FIG. 10, the opening 128 and the retaining member 151 are opposed on the top wall 112, meaning that they are positioned approximately 180 degrees apart. In addition, the closure member 130 is positioned near the retaining member 151. Specifically, the first end 132 extends from a portion of the lid 110 proximate the retaining member 151. In this configuration, the closure member 130 is easily moved between the first and second positions P1, P2. It is understood that the positions of the opening 128 and the retaining member 151 can vary according to the design parameters. The specific location of the closure member 130 on the skirt 127 may also vary with the design parameters.

Figure 11:
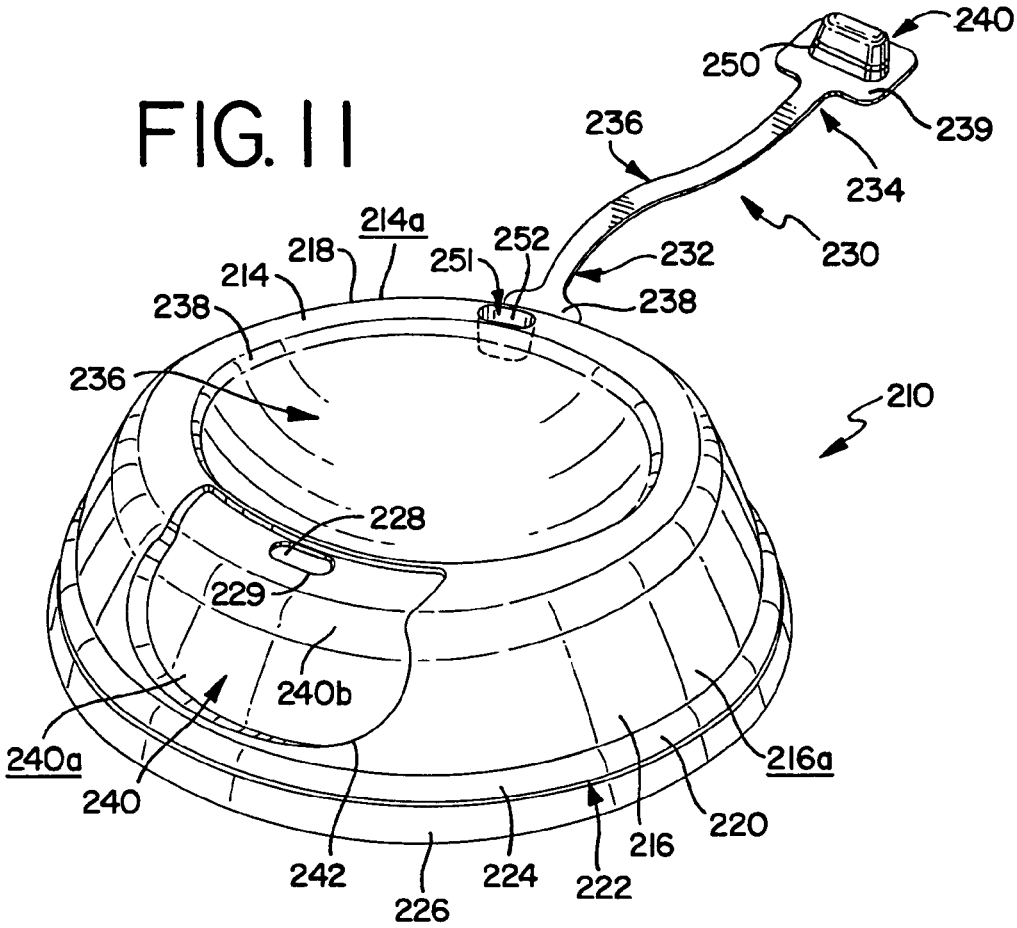
FIG. 11 is a perspective view of an alternate embodiment of the lid of the present invention, showing a closure member extending transversely from the lid; and, FIG. 12 is a perspective view of an alternate embodiment of the lid of the present invention, showing a closure member extending from the lid.

FIG. 11 discloses another preferred embodiment of the lid of the present invention. As shown in FIG. 11, the lid 210 generally includes an annular top wall 214 and a side wall 216 depending from an outer or peripheral edge 218 of the top wall 214. Although the top wall 214 is shown as having a generally flat upper surface 214*a*, the upper surface 214*a* can be curved or angled. The side wall 216 has a side wall surface 216*a* and a lower edge 220. The side wall surface 216*a* can be curved, angled, or generally flat. The overall shape of the lid 210 is generally frustaconical, however, the lid 210 can have a number of other configurations.

A mounting portion 222 depends from the lower edge 220 of the side wall 218. The mounting portion 222 includes a generally annular flange 224 and a generally annular skirt 226. The mounting portion 222 is adapted for connecting the lid 210 to the container in a manner that seals the lid 210 on the container. Thus, the mounting portion 222 prevents leakage of the container contents between the lid 210 and the container when the lid 210 is positioned on the container. In a preferred embodiment, the mounting portion 222 is integral with the side wall 216.

An aperture or drink opening 228 is located preferably in the top wall 216. Alternatively, the drink opening 228 is located in the side wall 216. The opening 228 is adapted to permit the passage or flow of the flowable contents held by the container through the cover 212. The opening 228 has an edge 229 that defines the shape of the opening 228. Although shown in FIG. 11 as having an obround shape, the opening 228 can have a variety of shapes, including but not limited to circular, square, or rectangular.

The opening 228 can be formed with a range of dimensions. At a minimum, the opening 228 should have dimensions sufficient to permit the passage of the flowable substance held by the container. The opening 228 can be located at various positions along the top wall 214 depending upon design parameters.

As shown in FIG. 11, a center portion 236 is positioned radially inward from an inner edge 238 of the top wall 214. Preferably, the center portion 236 is recessed such that the center portion 236 has a curvilinear configuration when viewed in cross-section. Described in a different manner, the center portion 236 has a concave shape when the portion 236 is viewed from a point above the lid 210. The degree of recess or curvature of the center portion 236 can vary with the design parameters of the lid 210.

The side wall 216 has a recessed portion 240 that is adapted to receive a lip of a person drinking from the container. An edge 242 of recessed portion 240 defines the configuration of the portion 240. The recessed portion 240 and the recessed surface 240*a* are positioned radially inward from the side wall surface 216*a*. Although the recessed portion 240 is shown positioned on both the top wall 214 and the side wall 216, the recessed portion 240 can be limited to either the top wall 214 or the side wall 216. The shape and configuration of the recessed portion 240 can be varied to conform to numerous design parameters. Similarly, the degree of recess of the portion 240 can vary. Preferably, the recessed portion 240 is positioned about the drink opening 228. The top wall 214 and the side wall 216 cooperate to form a rounded edge 240*b* at the recessed portion 240.

The lid 210 also has a closure member 230. Preferably, the closure member 230 is positioned on a portion of the annular skirt 226. The closure member 230 includes a first end 232, a second end 234, and an intermediate portion 236. The first end 232 includes a base portion 238. Preferably, the first end 232 extends from the skirt 226, however, the first end 232 could depend from a portion of the top wall 212, the side wall 218, or the mounting portion 224. The closure member 230 is preferably formed from the same material of the lid 210. The closure member 230 is adapted to be flexible. The second end 234 has a tab 239 and a plug 240. A notch 250 can be located between an upper portion and an lower portion of the plug 240.

As shown in FIG. 11, a retaining member 251 is preferably located in the top wall 212. Alternatively, the retaining member 251 is located in a portion of the side wall 216 or a portion of the mounting portion 222. The retaining member 251 includes a cavity 252 adapted to receive and/or secure the plug 240 of the closure member 230. An inner wall depends from an upper edge (not shown) of the member 251 and terminates at a generally planar bottom wall. The retaining member 251 is generally configured to receive at least a portion of the plug 240 in an interference fit as described in greater detail below.

At a first position P1, the opening 228 receives at least a portion of the plug 240. When the plug 240 is located in the first position, the edge 229 of the opening 228 is in frictional engagement with a portion of the plug 240. Described in a different manner, the plug 240 and the opening 228 are in an interference fit wherein at least a portion of the plug 240 is positioned below the top wall 212. When the closure member 230 is in the first position P1, the plug 240 forms a seal with the opening 228. This seal prevents the flow of the flowable substance in the container through the opening 228, enabling the container and lid 210 to be moved without risking spillage.

At a second position, P2, the retaining member 251 receives at least a portion of the plug 240. When the plug 240 is located in the second position P2, a portion of the retaining member 251 is in frictional engagement with a portion of the plug 240. Described in a different manner, the plug 240 and the cavity 252 are in an interference fit wherein at least a portion of the plug 240 are positioned below the top wall 212. When the closure member 230 is in the second position P2, the plug 240 is secured in place thereby preventing unwanted movement of the closure member 230. This securement prevents the plug 240 and the closure member 230 from becoming dislodged while a user discharges the contents of the container through the opening 228. By retaining the plug 240 in the second position P2, the closure member 230 does not interfere with a user discharging the flowable contents through the opening 228.

Referring to FIG. 11, the opening 228 and the retaining member 251 are opposed on the top wall 214, meaning that they are positioned approximately 180 degrees apart. In addition, the closure member 230 is positioned near the retaining member 251. Specifically, the first end 232 extends from a portion of the lid 210 proximate the retaining member 251. In this configuration, the closure member 230 is easily moved between the first and second positions P1, P2. Unlike prior art designs, the dimensions and the configuration of the opening 228 are not affected by the engagement and disengagement of the plug 240 as the closure member 230 is moved between the first and second positions P1, P2. This attribute allows a user to repeatedly move the closure member 230 between the first position P1 and the second position P2.

The lid 210 has a generally thin-wall construction. Although shown as having a generally circular shape, the lid 210, including the mounting portion 222, can have numerous configurations. For example, the lid 210 could have a rectangular, square, or oval shape. To ensure a leak-proof seal with the container, the shape of the mounting portion 222 should match the shape of the upper edge of the container so a cooperative sealing engagement can be achieved.

Figure 12:
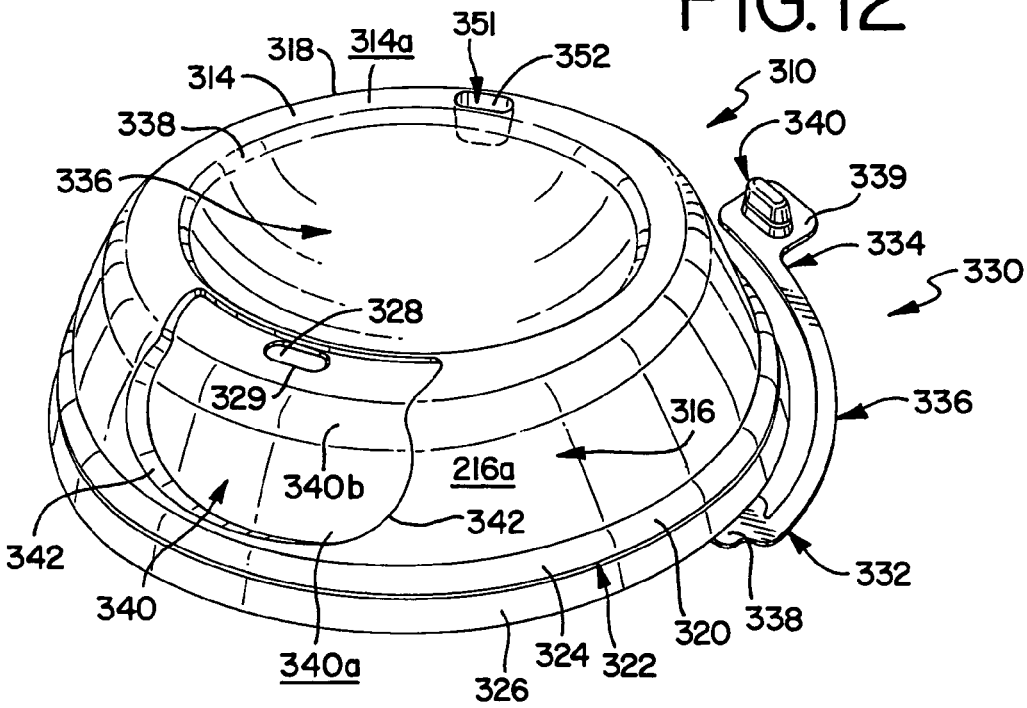

FIG. 12 discloses another preferred embodiment of the lid of the present invention. As shown in FIG. 12, the lid 310 is similar to the lid 210 shown in FIG. 11. However, the closure member 330 originates from a position between the opening 328 and the retaining member 351. Specifically, the first end 332 of the closure member 330 is positioned approximately 90 degrees from the opening 328. Described in another manner, the first end 332 is positioned approximately 90 degrees from retaining member 351. Described in yet another manner, the second end 334 is positioned approximately 180 degrees from the opening 328.

In addition, the closure member 330 has a curvilinear, arc shape that is similar to the curvilinear shape of the mounting portion 324 and/or the top wall 312. The arc length of the closure member 330, as measured from the first end 332 to the second end 334, can vary according to numerous design parameters. Preferably, the arc length ranges from one-fifth to one-half the circumference of the top wall 312. In a most preferred embodiment, the arc length is approximately 90 degrees. Described in another manner, a vector drawn radially inward from each of ends 332, 334 would intersect to form an approximately 90 degree angle. The closure member 330 can be moved between a first position and a second position as described above.

While the specific embodiments have been illustrated and described, numerous modifications come to mind without significantly departing from the spirit of the invention and the scope of protection is only limited by the scope of the accompanying claims.

What is claimed is:

1. A lid for a container holding a flowable substance, the lid comprising:

a body having a top wall and a recessed central portion, the top wall having an opening residing entirely in the top wall, with a bottom wall positioned below the top wall, wherein the retaining recess and the opening are in an opposed positional relationship, the body further having a side wall with a mounting portion adapted to mount on the container; and, a closure member affixed to the body, the closure member movable between a first position wherein at least a portion of the closure member obstructs the opening, and a second position wherein at least a portion of the closure member is received by the retaining recess.

2. The lid of claim 1, wherein the closure member includes a base portion, a connector arm, and a plug, the connecting arm located between the base portion and the plug.

3. The lid of claim 2, wherein the opening and the plug are cooperatively dimensioned such that the plug is removably received by the opening.

4. The lid of claim 2, wherein the connector arm is flexible to accommodate movement of the closure member between the first and second positions.

5. The lid of claim 1, wherein the body has a lip receiving area for receiving an upper lip of a person drinking from the container, the lip receiving area being located radially inward of the top wall and the drink opening, the lip receiving area having a height defined between the top wall and the central portion.

6. The lid of claim 1, wherein movement of the closure member between the first and second positions occurs along a curvilinear path above the top wall.

7. A lid for a container holding a flowable substance, the lid comprising:

a body having a top wall defining a generally circular periphery and a recessed central portion, the top wall having an opening residing entirely in the top wall, with a bottom wall positioned below the top wall, wherein the opening and the retaining recess are positioned at opposite ends of a diameter passing through the top wall, the body further having a side wall with a mounting portion adapted to mount on the container; and, a closure member affixed to the body, the closure member movable between a first position wherein at least a portion of the closure member is received by the opening, and a second position wherein at least a portion of the closure member is received by the retaining recess.

8. The lid of claim 7 wherein, the closure member is affixed to the body between the opening and the retaining recess.

9. The lid of claim 8, wherein the closure member includes a base portion, a connector arm, and a plug, the connecting arm located between the base portion and the plug, the base portion being connected to the body between the opening and the retaining recess.

10. The lid of claim 9, wherein the opening and the plug are cooperatively dimensioned such that the plug is removably received by the opening.

11. The lid of claim 9, wherein the connector arm is flexible to accommodate movement of the closure member between the first and second positions.

12. The lid of claim 8, wherein the body has a lip receiving area for receiving an upper lip of a person drinking from the container, the lip receiving area being located radially inward of the top wall and the drink opening.

13. The lid of claim 8, wherein movement of the closure member between the first and second positions occurs along a curvilinear path above the top wall.

14. The lid of claim 8, wherein the top wall has an annular configuration.

15. A lid for a container holding a flowable substance, the lid comprising:

a body having a top wall with a drink opening entirely in the top wall, a central portion radially inward of the top wall, a mounting portion adapted to connect the lid to the container, and a sidewall extending vertically between the mounting portion and the top wall, the body further having a retaining recess positioned, the retaining recess having a bottom wall positioned below the top wall;

the closure member is received by the opening, and a second position wherein at least a potion of the closure member is secured by the retaining recess;

wherein an inner wall extends between an inner edge of the top wall and the central portion, and wherein the inner wall height at the drink opening exceeds the inner wall height ninety degrees from the drink opening.

* * * * *